US009623339B2

(12) United States Patent
Fisher

(10) Patent No.: US 9,623,339 B2
(45) Date of Patent: Apr. 18, 2017

(54) WATER JET RIDE

(71) Applicant: Skyturtle Technologies Ltd., Enderby (CA)

(72) Inventor: Lance Craig Fisher, Enderby (CA)

(73) Assignee: Skyturtle Technologies Ltd., Enderby (CA)

( * ) Notice: Subject to any disclaimer, the term of this patent is extended or adjusted under 35 U.S.C. 154(b) by 0 days.

(21) Appl. No.: 14/981,565

(22) Filed: Dec. 28, 2015

(65) Prior Publication Data

US 2016/0136530 A1 May 19, 2016

Related U.S. Application Data

(63) Continuation of application No. 14/106,328, filed on Dec. 13, 2013, now Pat. No. 9,220,989.

(60) Provisional application No. 61/736,975, filed on Dec. 13, 2012.

(51) Int. Cl.
*A63G 21/18* (2006.01)
*A63G 3/00* (2006.01)

(52) U.S. Cl.
CPC ..... *A63G 21/18* (2013.01)

(58) Field of Classification Search
CPC . A63G 3/00; A63G 3/06; A63G 21/00; A63G 21/08; A63G 31/00; A63G 31/02; A63H 23/10
USPC ..... 472/13, 117, 128, 129; 104/53, 69, 70, 104/73
See application file for complete search history.

(56) References Cited

U.S. PATENT DOCUMENTS

| | | | |
|---|---|---|---|
| 3,848,537 | A | 11/1974 | Rodot |
| 3,930,450 | A | 1/1976 | Symons |
| 5,213,547 | A | 5/1993 | Lochtefeld |
| 5,230,662 | A | 7/1993 | Langford |
| 5,503,597 | A | 4/1996 | Lochtefeld et al. |
| 5,716,282 | A | 2/1998 | Ring et al. |
| 5,989,126 | A | 11/1999 | Kilbert et al. |
| 6,527,646 | B1 | 3/2003 | Briggs |
| 7,430,966 | B2 | 10/2008 | Mabillard et al. |
| 7,896,752 | B2 | 3/2011 | Yule |
| 7,942,752 | B2 | 5/2011 | Henry |
| 8,070,616 | B2 | 12/2011 | Dubois et al. |
| 8,282,497 | B2 | 10/2012 | Henry et al. |

FOREIGN PATENT DOCUMENTS

| | | | |
|---|---|---|---|
| FR | 2619548 | A1 | 2/1989 |
| GB | 445595 | A | 1/1935 |
| JP | 10216363 | | 9/1998 |
| WO | 2009141588 | A2 | 11/2009 |
| WO | 2014059551 | A1 | 4/2014 |

*Primary Examiner* — Kien Nguyen
(74) *Attorney, Agent, or Firm* — Schacht Law Office, Inc.; Dwayne Rogge

(57) ABSTRACT

An apparatus for transporting a rider comprising a vehicle adapted to support the rider wherein vehicle has a driven portion disposed along a bottom surface thereof and a track having a path sized to slidably receive the vehicle therein and a plurality of water jets disposed along the track along a path of travel of the driven portion. Each of the plurality of water jets is adapted to sequentially discharge a portion of water in a desired direction of travel of the vehicle there through when aligned with the driven portion such that the portion of water engages the driven portion.

18 Claims, 8 Drawing Sheets

WATER JET RIDE

RELATED APPLICATIONS

This application claims priority benefits of, and is a Continuation of U.S. Ser. No. 14/106,328, filed Dec. 13, 2013, and incorporated herein by reference. U.S. Ser. No. 14/106,328 claims priority from U.S. Provisional Patent Application No. 61/736,975 filed Dec. 13, 2012 entitled SEQUENCED IMPULSE JETS FOR WATER PARK ATTRACTIONS.

BACKGROUND OF THE DISCLOSURE

Field of the Disclosure

This disclosure relates to waterslides in general and in particular to a method and apparatus for using jetted water flow as a method of motive force on a vehicle within a track.

Background Art

Water slides are a common and popular recreational activity. Water slides commonly are comprise a track formed of a tubular or contoured track with a flow of water traveling from the top to the bottom to convey a rider. Conventional waterslides rely completely on gravity and the flowing water to convey the rider to the bottom of the slide. Such conventional waterslides use only potential energy gained from climbing a tower to move the vehicle down the slide. Using only potential energy creates the disadvantages of not being able to start motion on a flat section (launching) and not being able to climb to a height greater than the proceeding drop.

In recent years, waterslides have been developed utilizing water jets to assist the rider up inclines or otherwise propel the rider along the slide so as to provide greater flexibility in slide design as well as enable the construction of longer slides. Such rides use a large jet at the bottom of an uphill section to propel a rider or rider upon a raft. In such rides, the jet is continuously run to apply a motive force at the bottom of the hill. Examples of such devices are illustrated in U.S. Pat. No. 5,230,662 to (1991) Langford and U.S. Pat. No. 8,070,616 to Dubois. However these jets are commonly directed only to hit the raft or rider at any location at which ever location is in the direct path of the jets. Accordingly, the interface between the jets and the raft or rider may not correspond to a region which effectively drives the rider or raft forward. Additionally, such jets are continuously on such that a rider may be undesirably sprayed or impacted by the water ejected therefrom.

SUMMARY OF THE DISCLOSURE

According to a first example, there is disclosed an apparatus for transporting a rider comprising a vehicle adapted to support the rider wherein vehicle has a driven portion disposed along a bottom surface thereof. The apparatus further comprising a track having a path sized to slidably receive the vehicle therein and a plurality of water jets disposed along the track along a path of travel of the driven portion. Each of the plurality of water jets is adapted to sequentially discharge a portion of water in a desired direction of travel of the vehicle therethrough when aligned with the driven portion such that the portion of water engages the driven portion.

The driven portion may comprise a plurality of vanes extending from the bottom surface of the vehicle. The vanes may extend from a longitudinal midline of the vehicle. The vanes may extend transversely from a midline of the vehicle. The vanes may have an arcuate profile.

The vanes may be arranged in pairs to opposed sides of the midline of the vehicle. The driven portion may comprise a plurality of pairs of vanes arranged longitudinally along the bottom surface of the vehicle. The vanes may be formed integrally with the vehicle. The vanes may be formed on a plate secured to the bottom surface of the vehicle.

The water jets may be arranged in drive sections along the track. Each drive section may comprise a pair of substantially parallel spaced apart water jets arranged transversely across the track. The waterjets may be oriented at an angle between 0 and 90 degrees relative to a normal surface of the track.

Each water jet may be adapted to discharge a burst of water when aligned with the driven portion. Each water jet may be adapted to be closed after the driven portion has passed.

The apparatus may further comprise at least one valve associated with the plurality of jets adapted to permit a flow of water through the jets. The valves may comprise a unique valve for each drive section.

The apparatus may further comprise at least one sensor for activating the plurality of water jets. The apparatus may further comprise a timer for sequencing the water jets when activated by the at least one sensor. The sensors may comprise a unique sensor for each drive section.

According to one example of the present disclosure there is disclosed a method for transporting a rider comprising providing a vehicle adapted to support the rider wherein the vehicle has a driven portion disposed along a bottom surface thereof. The apparatus further comprises a track having a path sized to slidably receive the vehicle therein and sequentially discharging a portion of water in a desired direction of travel of the vehicle through a plurality of water jets disposed along the track along of a path of travel of the driven portion when aligned with the driven portion such that the portion of water engages the driven portion.

Other aspects and features of the disclosed examples will become apparent to those ordinarily skilled in the art upon review of the following description of specific examples in conjunction with the accompanying figures.

BRIEF DESCRIPTION OF THE SEVERAL VIEWS OF THE DRAWINGS

In drawings which illustrate embodiments wherein similar characters of reference denote corresponding parts in each view.

DETAILED DESCRIPTION OF THE DISCLOSURE

Figure 1:
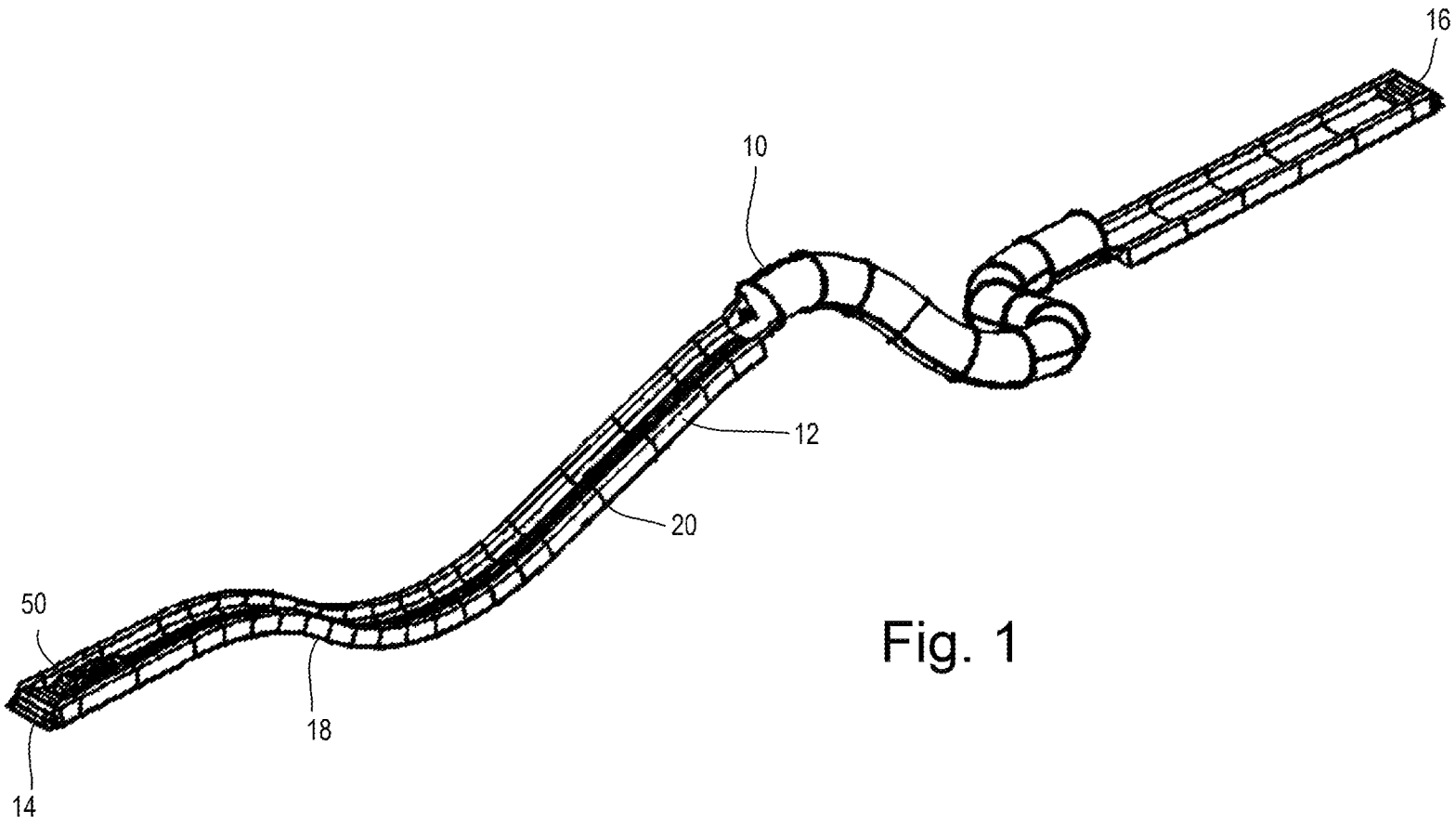
FIG. 1 is a perspective view of one example of a water slide.

Referring to FIG. 1, water slide according to one example is shown generally at 10. The water slide 10 comprises an elongate track 12 having a beginning 14 and a finish 16. The track 12 may optionally include one or more downhill portions 18 and one or more uphill portions 20. Although both downhill and uphill portions are illustrated in FIG. 1, it will be appreciated that any combination of uphill, downhill, level and turning portions may be combined for the desired ride. As illustrated in FIG. 1, the track 12 includes at least one vehicle 50 operable to be received within the track and propelled there along as will be more fully described below.

Figure 2:
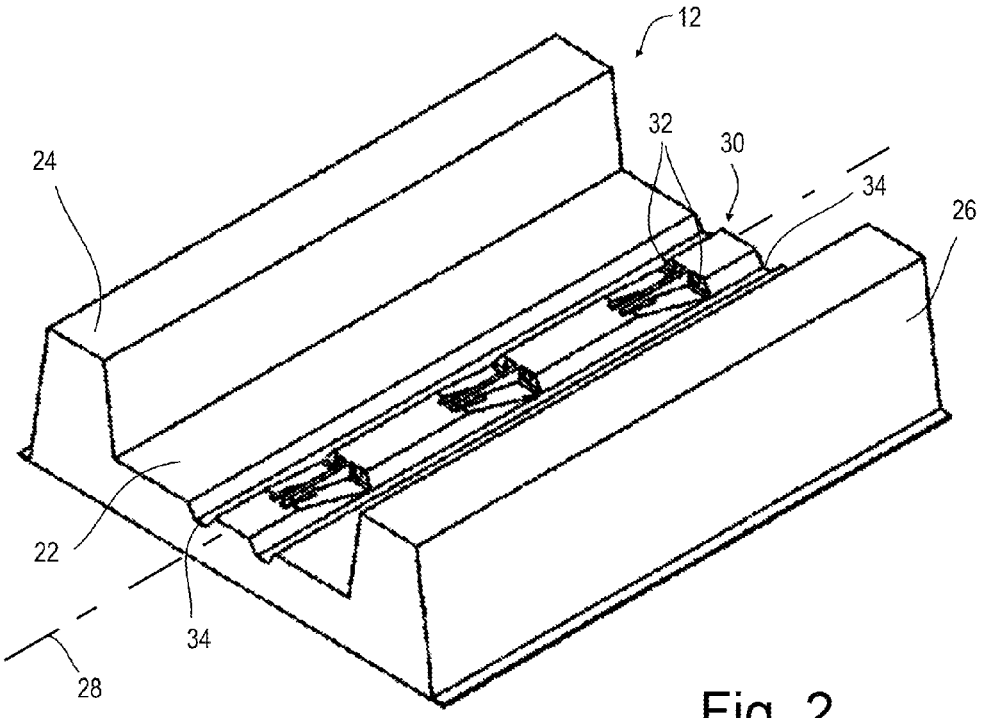
FIG. 2 is a perspective view of a section of the water slide track of FIG. 1.

Turning now to FIG. 2, a portion of the track is illustrated. The track comprises a bottom running surface 22, and first and second side walls, 24 and 26, respectively. The bottom running surface 22 supports the vehicle within the track while the first and second side walls 24 and 26 contain the vehicle laterally to remain within the track 12. Although the track is illustrated in FIG. 2 as having a substantially rectangular cross-section, it will be appreciated that other cross-sections may also be utilized, such as, by way of non-limiting example, circular, oval, or irregular. It will furthermore be appreciated that for non-rectangular cross-sections, the bottom surface and side walls may be blended together so as to not form distinct corners there between as illustrated in FIG. 2.

Figure 6:
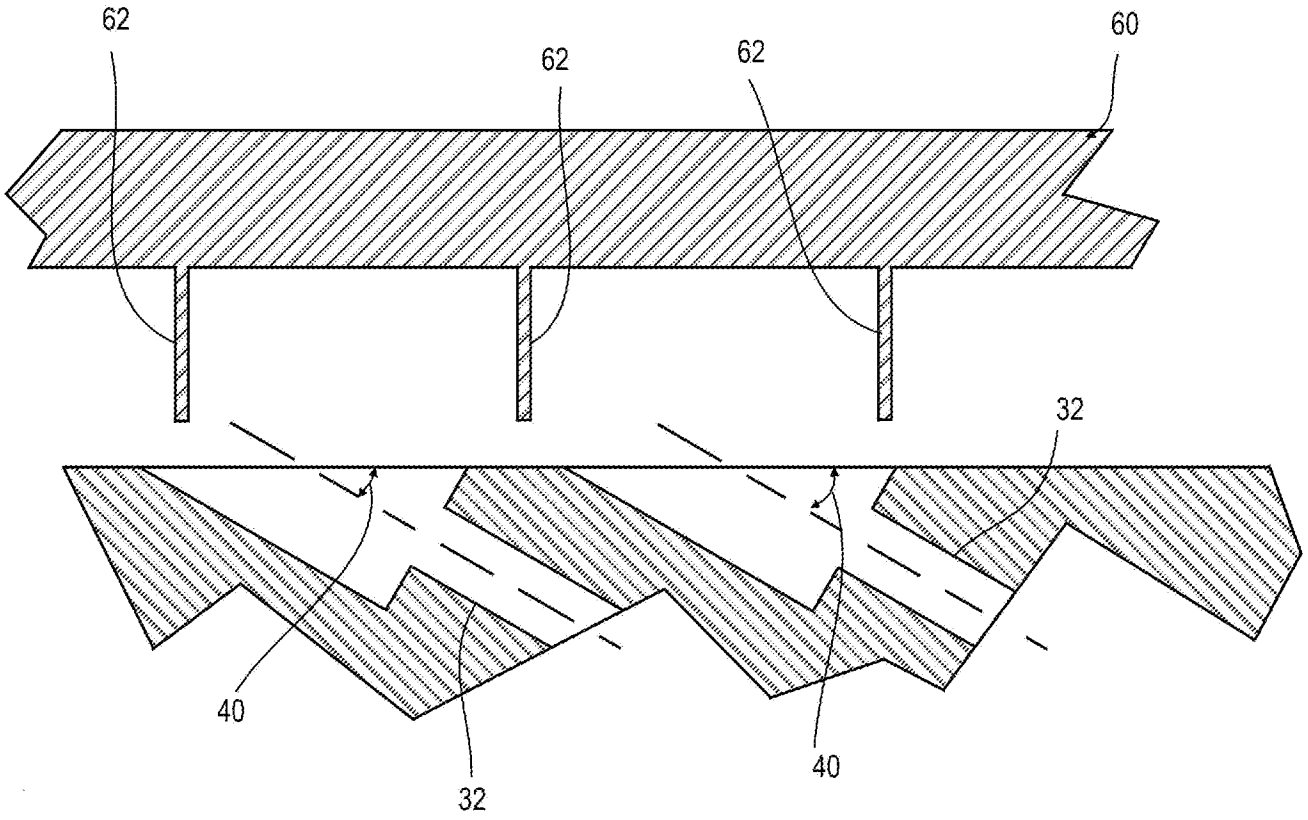
FIG. 6 is a cross sectional view of the vehicle located above the water jets as taken along the line 6-6.

The bottom surface 22 of the track 12 includes a drive 30 extending there along comprising a plurality of water jets 32 oriented generally in the intended direction of travel of the vehicle 50. The track 12 of this example includes a midline axis 28 extending there along on which matching pairs of water jets 32 are arranged to either side thereof. Although the water jets 32 are illustrated as extending along the length of the track section shown in FIG. 2, it will be appreciated that the water jets 32 may extend along the entire track 12 or only sections thereof where additional propulsion is required. As illustrated in FIG. 2, the track 12 may include guide grooves 34 located to the outside of the water jets 32. The guide grooves 34 may engage with corresponding protrusions on the bottom of the vehicle to maintain the vehicle along a desired path or may optionally be used to drain excess water from the drive location. The water jets 32 are shown angled upwards relative to the bottom surface so as to be directed at and adapted to engage a portion of the vehicle as it passes there over. With reference to FIG. 6, the water jets 32 of this example are angled upwards by an inclination angle 40 which may be selected to be between 0° and 90°.

Figure 3:
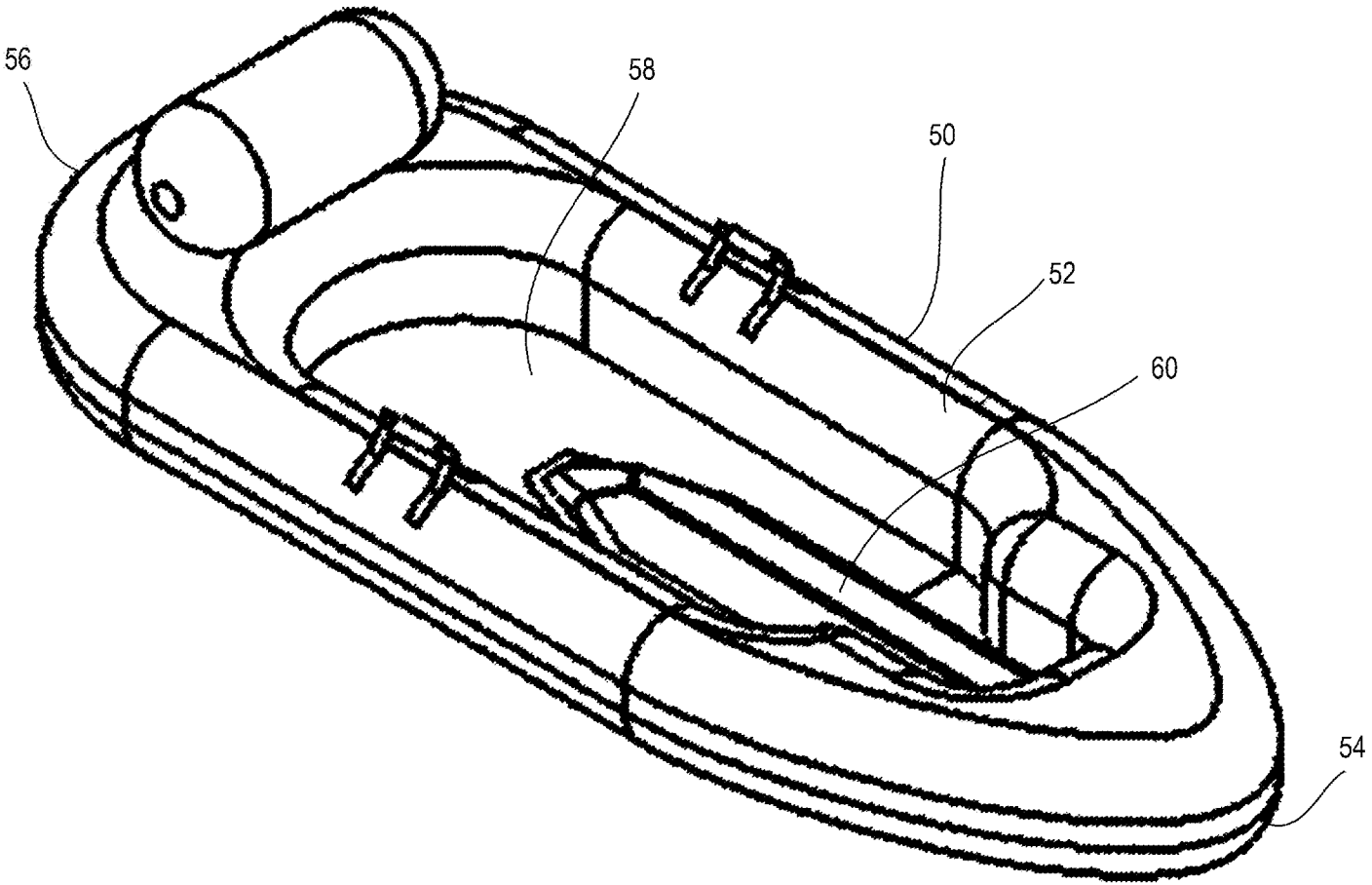
FIG. 3 is a perspective view of a vehicle for use in the water slide track of FIG. 1.
Figure 4:
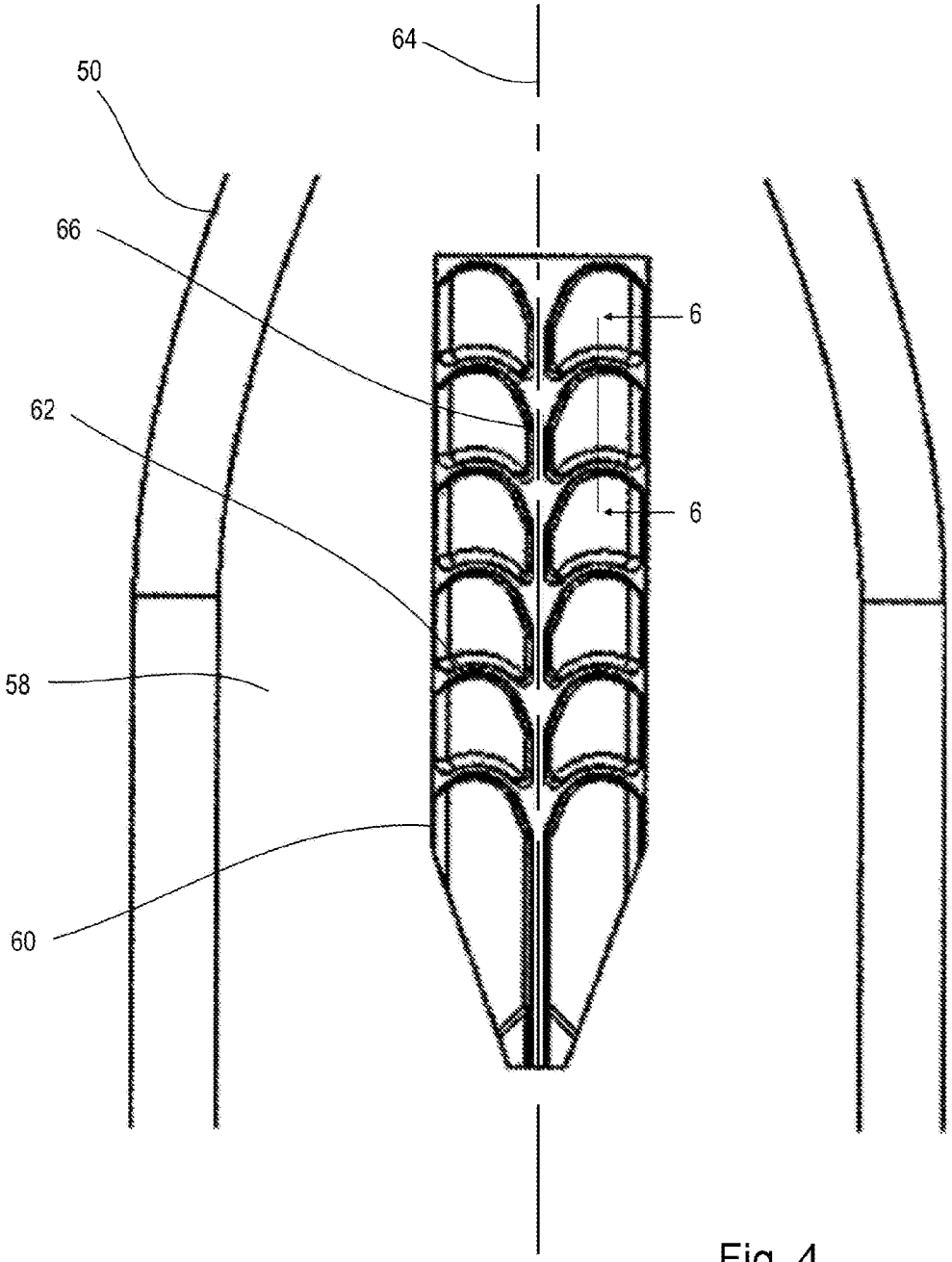
FIG. 4 is a bottom plan view of the vehicle of FIG. 3

Turning now to FIGS. 3 and 4, a vehicle for use in the track is shown generally at 50. The vehicle 50 comprises an outer body 52 having front and rear ends, 54 and 56, respectively. As illustrated, the outer body 52 may be formed of an inflatable body as is commonly known in the art. The vehicle 50 includes a bottom panel 58 which provides a surface for an occupant to sit on within the outer body. As illustrated, the bottom panel 58 may include a plate 60 thereon which contains a plurality vanes 62 extending from the bottom of the vehicle 50. The vanes 62 are arranged in pairs along a midline 64 of the vehicle 50 substantially corresponding to the axis 28 of the track 12. The vanes 62 are adapted to be engaged by water exiting the water jets 32 so as to propel the vehicle 50 in the desired direction of travel. The plate 60 may include a longitudinal ridge 66 extending along the midline 64 thereof from which the vanes extend so as to provide separation from each other. The plate 60 may either be a separate component secured to the bottom of the vehicle 50 or may optionally be formed integrally therewith. The vanes 62 are shown arranged in pairs to either side of the ridge 66 and it will be appreciated that any quantity of vanes may be selected depending on the amount of driving force desired. The vanes 62 may also be longitudinally spaced apart by a distance along the longitudinal midline 54 to permit each vane to be successively driven by the water jet 32 without interference from the preceding or following vane. By way of non-limiting example, the vanes 62 may be spaced apart along the plate by a distance of between 2 and 48 inches (51 and 1219 mm).

Figure 5:
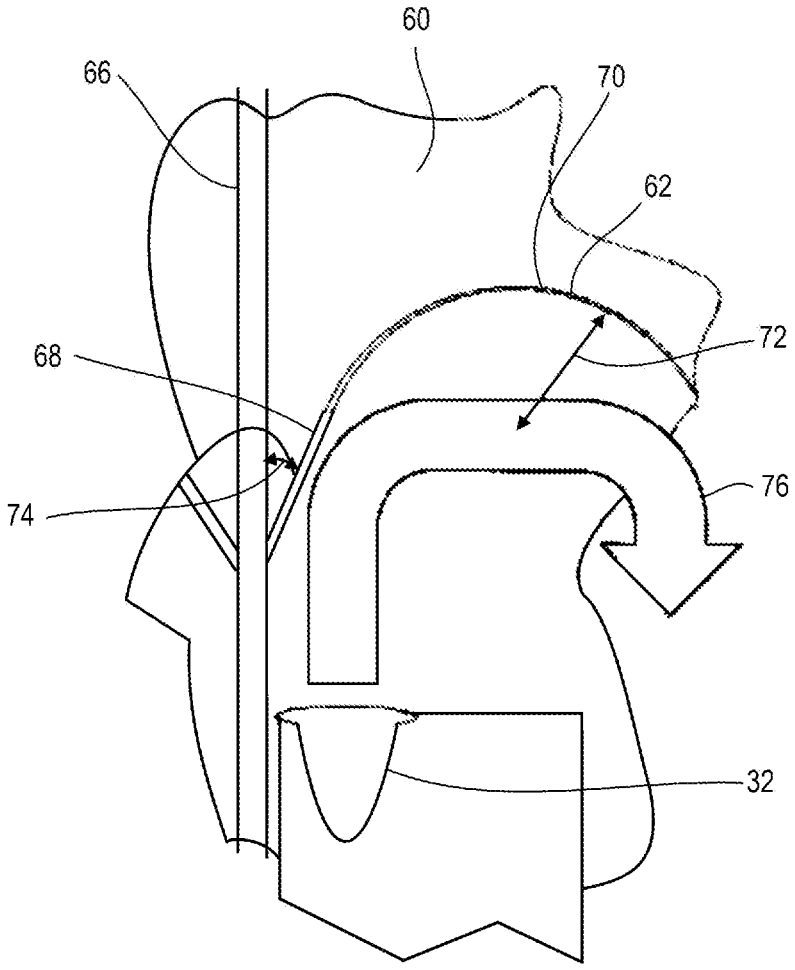
FIG. 5 is a detailed view of one of the vanes of the vehicle of FIG. 3 with a path of water flow illustrated.

As illustrated in FIGS. 5 and 6, the plate 60 and vanes 62 comprises a driven portion on the vehicle 50 while the water jets 32 comprises a drive to urge the vehicle along the track 12. With reference to FIG. 5, each vane 62 may include a substantially straight portion 68 and an arcuate portion 70. The straight portion 68 extends angularly from the ridge 66 by an initial angle 74. The initial angle 74 may be selected such that the straight portion extends from the ridge 66 in a direction of travel of the vehicle 50. The arcuate portion 70 curve the vane back in an opposed direction to the intended travel of the vehicle 50 such that water discharged from the water jet 32 is collected by the vane and directed back towards the water jet along a flow path generally indicated at 76. The arcuate portion 70 may have a radius of curvature generally indicated at 72 selected to be between 2 and 24 inches (51 and 610 mm).

Figure 7:
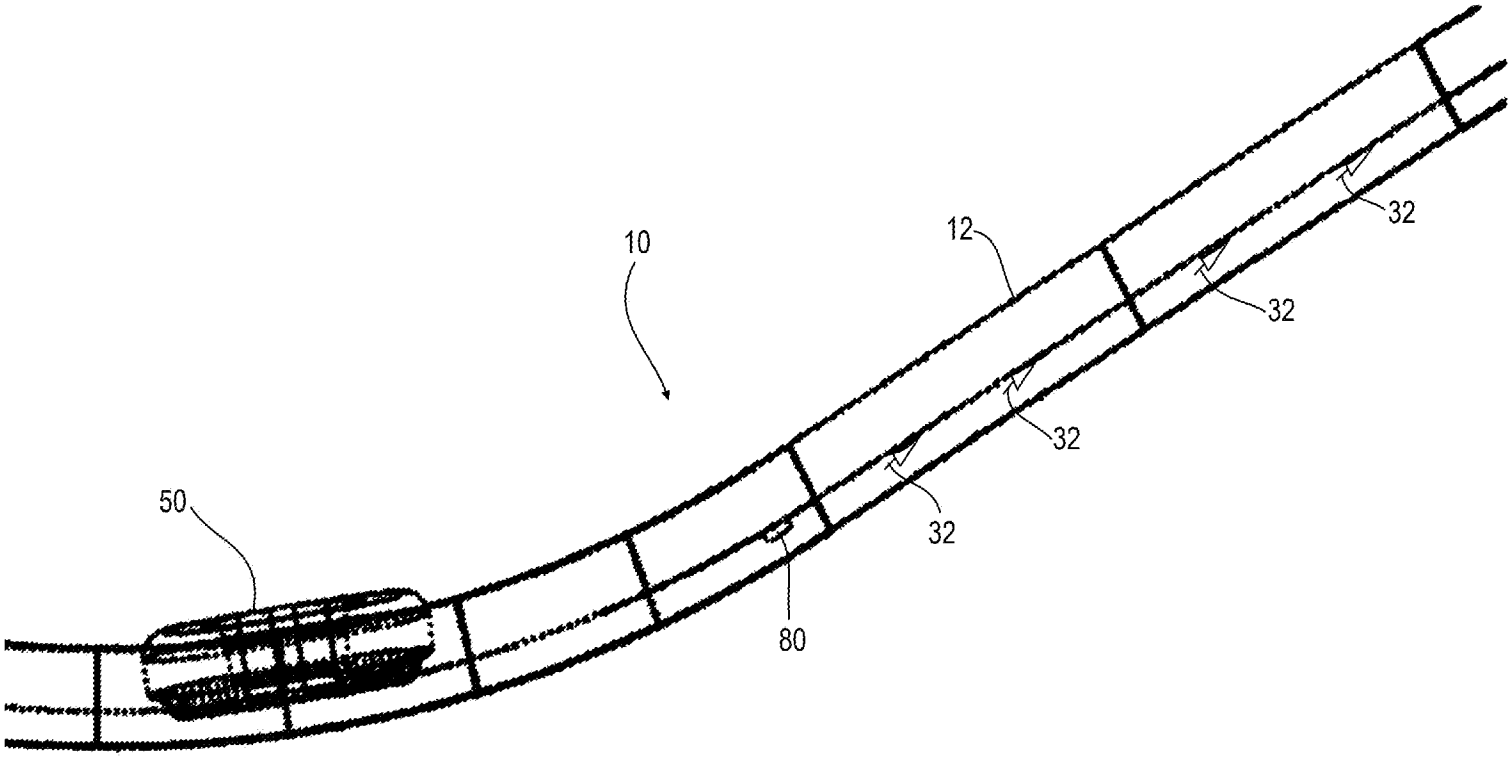
FIG. 7 is a side view of the vehicle mounted in a track of the water slide of FIG. 1 at a first position.
Figure 8:
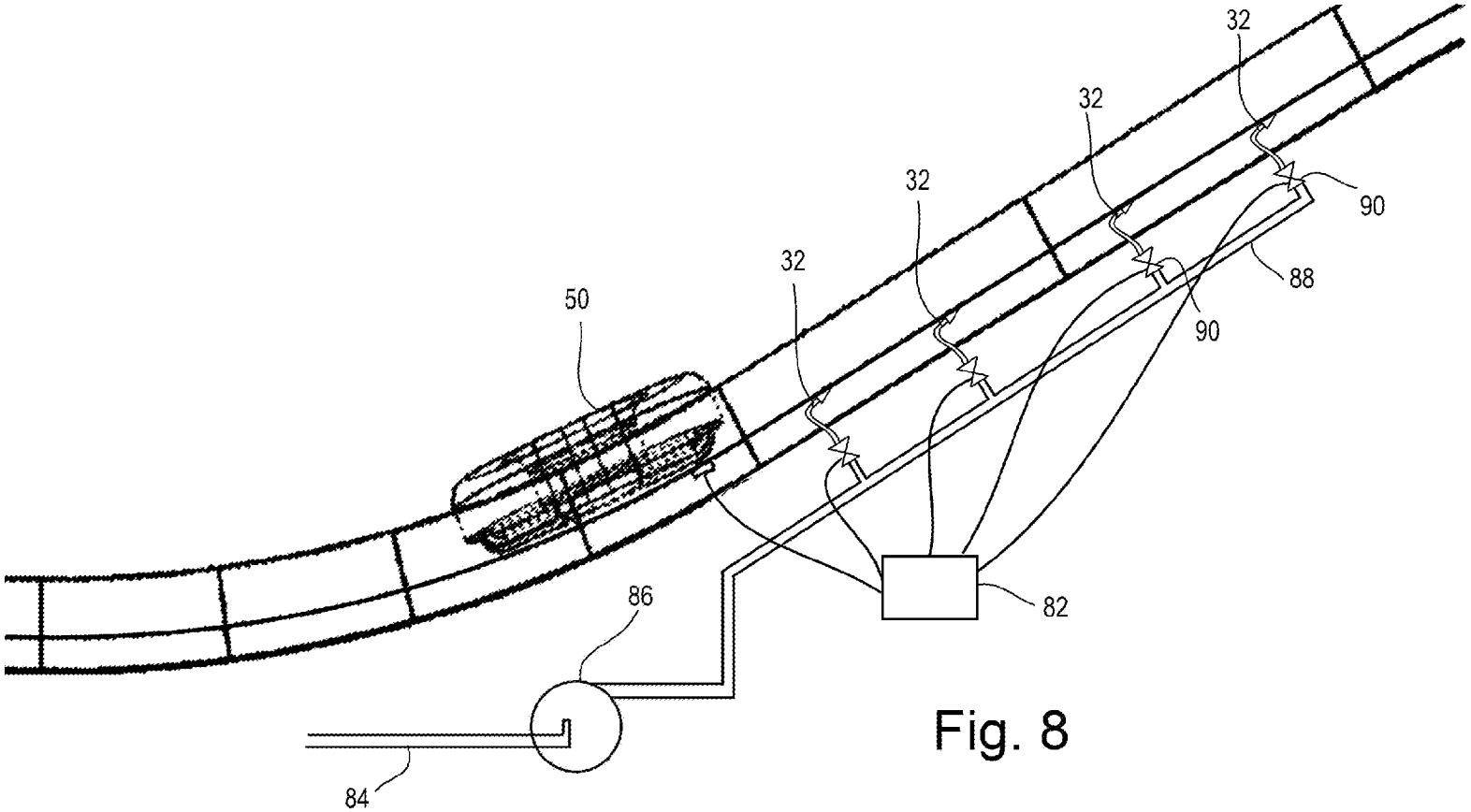
FIG. 8 is a side view of the vehicle mounted in a track of the water slide of FIG. 1 at a second position.

Turning now to FIGS. 7 and 8, the track 12 may have a sensor 80 located therealong at a location upstream of the water jets 32. The sensor 80 is adapted to sense the presence of the vehicle 50 or passage therepast. Examples of such sensor 80 may include but are not limited to proximity sensors, broken light beams, position switches or the like. The sensor 80 indicates to a processor circuit 82 that the vehicle 50 is approaching. In one example, the processor circuit includes a microprocessor or other suitable processor circuit as are generally known in the art. The processor circuit in turn causes valves 90 to be opened at a predetermined time interval as the vehicle 50 is passing thereover. The valves 90 are supplied with a water supply via a network of piping 88 including a pump 86, and water supply 84. In particular, the valves 90 are adapted to fluidly connect each water jet 32 with the piping 88 and thereby to discharge a portion of the water from the piping through the water jet. The processor circuit 82 in one example will also cause the valves 90 to close at a time interval corresponding to when the vehicle has passed thereover.

As illustrated, the system may include a single sensor 80 for use with a plurality or bank of water jets as illustrated in FIGS. 7 and 8. In such arrangements, each valve 90 may be provided with its own timing to turn on and off at a unique time interval depending upon the speed and path of travel desired of the vehicle. Furthermore in such arrangements, the indication of the approach of the vehicle will initiate the water jet sequence as controlled by the processor circuit. It will also be appreciated that separate sensors 80 may also be used for each water jet or pair of water jets individually. Furthermore, the sensor may be located proximate to the water jet or slightly downstream thereof so as to sense the vehicle 50 when it is located above the water jet 32. In such arrangements, the sensor may be wired directly to the associated valve so as to activate it directly. Optionally, the sensors 80 may be omitted and all the valves of the ride directly controlled by the processor circuit.

More generally, in this specification, including the claims, the term "processor circuit" is intended to broadly encompass any type of device or combination of devices capable of performing the functions described herein, including (without limitation) other types of microprocessors, microcontrollers, other integrated circuits, other types of circuits or combinations of circuits, logic gates or gate arrays, or programmable devices of any sort, for example, either alone or in combination with other such devices located at the same location or remotely from each other, for example. Additional types of processor circuits will be apparent to those ordinarily skilled in the art upon review of this specification, and substitution of any such other types of processor circuits is considered not to depart from the scope of the present invention as defined by the claims appended hereto.

While specific embodiments of the invention have been described and illustrated, such embodiments should be considered illustrative of the invention only and not as limiting the invention as construed in accordance with the accompanying claims.

The invention claimed is:

1. An apparatus for transporting a rider comprising:

a vehicle adapted to support the rider, said vehicle having a driven portion disposed along a bottom surface thereof;

a track having a path sized to slidably receive said vehicle therein;

a plurality of water lets disposed along said track along a path of travel of said driven portion;

a timer for sequencing the plurality of water jets;

wherein each of said plurality of water jets is adapted to sequentially discharge a portion of water in a desired direction of travel of said vehicle therethrough when aligned with said driven portion such that said portion of water engages said driven portion;

said driven portion comprises a plurality of vanes extending from said bottom surface of said vehicle; and wherein said vanes extend from a longitudinal midline of said vehicle.

2. The apparatus of claim 1 further comprising at least one sensor sequencing the water jets when activated.

3. The apparatus of claim 1 wherein said vanes extend transversely from the longitudinal midline of said vehicle.

4. The apparatus of claim 1 wherein said vanes have an arcuate profile.

5. An apparatus for transporting a rider comprising:

a vehicle adapted to support the rider, said vehicle having a driven portion disposed along a bottom surface thereof;

a track having a path sized to slidably receive said vehicle therein;

a plurality of water lets disposed along said track along a path of travel of said driven portion;

a timer for sequencing the plurality of water jets;

wherein each of said plurality of water lets is adapted to sequentially discharge a portion of water in a desired direction of travel of said vehicle therethrough when aligned with said driven portion such that said portion of water engages said driven portion; and wherein said vanes are arranged in pairs to opposed sides of said midline of said vehicle.

6. The apparatus of claim 5 wherein:

said driven portion comprises a plurality of vanes extending from said bottom surface of said vehicle; and wherein said driven portion comprises a plurality of pairs of vanes arranged longitudinally along said bottom surface of said vehicle.

7. The apparatus of claim 5 wherein said vanes are formed integrally with said vehicle.

8. The apparatus of claim 5 wherein said vanes are formed on a plate secured to said bottom surface of said vehicle.

9. The apparatus of claim 5 wherein said water jets are arranged in drive sections along said track.

10. The apparatus of claim 9 wherein each drive section comprises a pair of substantially parallel spaced apart water jets arranged transversely across said track.

11. The apparatus of claim 9 further comprising at least one sensor for activating said plurality of water jets.

12. The apparatus of claim 11 wherein the timer for sequencing said water jets is activated by said at least one sensor.

13. The apparatus of claim 11 wherein said at least one sensor comprise a unique sensor for each drive section.

14. The apparatus of claim 5 wherein said water jets are oriented at an angle between 0 and 90 degrees relative to a normal surface of said track.

15. The apparatus of claim 5 wherein each water jet is adapted to discharge a burst of water when aligned with said driven portion.

16. The apparatus of claim 15 wherein each water jet is adapted to be closed after said driven portion has passed.

17. The apparatus of claim 16 further comprising at least one valve associated with said plurality of jets adapted to permit a flow of water through said jets.

18. The apparatus of claim 5 further comprising:

at least one valve associated with said plurality of jets adapted to permit a flow of water through said jets;

wherein said at least one valve comprises a unique valve for each drive section.

* * * * *